US005215571A

United States Patent [19]

Marcuson et al.

[11] Patent Number: 5,215,571

[45] Date of Patent: Jun. 1, 1993

[54] CONVERSION OF NON-FERROUS MATTE

[75] Inventors: Samuel W. Marcuson, Sudbury; Carlos Landolt, Lively; David E. Hall, Sudbury, all of Canada

[73] Assignee: Inco Limited, Toronto, Canada

[21] Appl. No.: 959,837

[22] Filed: Oct. 14, 1992

[51] Int. Cl.[5] ..... C22B 15/00

[52] U.S. Cl. ..... 75/626

[58] Field of Search ..... 75/649, 650

[56] References Cited

U.S. PATENT DOCUMENTS

| | | | |
|---|---|---|---|
| 3,968,956 | 7/1976 | Sugiura et al. | 266/226 |
| 4,045,215 | 8/1977 | Leroy et al. | 75/82 |
| 4,073,646 | 2/1978 | Kryczun | 75/650 |
| 4,469,513 | 9/1984 | Staib | 75/76 |
| 4,614,542 | 9/1986 | Kimura et al. | 75/76 |
| 4,830,667 | 5/1989 | Marcuson et al. | 75/76 |
| 5,007,959 | 4/1991 | Reist et al. | 75/645 |

OTHER PUBLICATIONS

Diaz, "Conversion of Nickel and Sulfur-Containing Copper to Blister" Copper 87 vol. 4, pp. 294–300 (Apr. 1988).

Nagano et al., "Commercial Operation of Mitsubishi Continuous Copper Smelting and Converting Process", *Int'l Symposium on Copper Extraction & Refining*, 1976, pp. 439–457.

*Primary Examiner*—Peter D. Rosenberg

*Attorney, Agent, or Firm*—Bruce S. Londa; Edward A. Steen

[57] ABSTRACT

A non-ferrous matte conversion process is disclosed in which molten non-ferrous matte, essentially nickel and/or copper sulfide and iron sulfide, is provided in a suitable vessel, such as a modified Pierce-Smith converter. The bath is stirred from below with a non-reactive sparging gas, such as nitrogen, and surfaceblown from above with an oxygen-containing gas. A flux is added to the melt to raise a fluid slag. In addition, cold crushed matte is added to the bath. The cold matte acts to maintain the temperature of the bath, so as to prevent overheating which can damage the converter lining. The matte addition also serves as a source for additional converter feed. As the reaction progresses, the slag layer is periodically skimmed, and additions of flux and cold matte are made when necessary. When it is no longer possible to raise a slag, a non-ferrous sulfide matte is obtained having a greatly reduced iron content.

10 Claims, No Drawings

CONVERSION OF NON-FERROUS MATTE

BACKGROUND OF THE INVENTION

The present invention relates to a process for converting iron-containing non-ferrous matte, such as nickel and/or copper matte.

More particularly, the present invention relates to a conversion process using a top blowing/bottom stirring mechanism, in which charges of cold non-ferrous matte are added to a molten bath of matte, while the iron content is continuously or periodically removed from the molten bath surface as slag. The conversion reaction is effected by blowing an oxygen-containing gas onto the bath surface, while stirring from below with a non-reactive sparging gas.

Specifically, nickel and/or copper sulfide furnace mattes may contain iron in amounts in excess of 30% by weight. By employing the novel process claimed herein, the iron content can be efficiently reduced to below 10% in the case of nickel and nickel/copper matte, and completely removed in the case of copper matte. Moreover, a steady, concentrated stream of $SO_2$ may be readily captured.

In general, the objective of a conversion process is to oxidize the iron sulfides in the matte to form iron oxides and to liberate sulfur dioxide, leaving matte comprising predominantly non-ferrous sulfides. In the initial stage, the removal of iron oxide is facilitated by the addition of a flux, such as silica in the case of nickel matte, which forms an immiscible iron silicate slag which may be skimmed from the top of the melt. In the case of copper matte, commonly used fluxes would be lime or silica. The slag may also contain other impurities which are oxidized in the process.

Traditionally, the oxygen-containing gas is injected into the molten bath via submerged tuyeres. This results in extreme wear of the tuyeres, due to the highly exothermic nature of the oxidation reaction, particularly at the point of injection. Attempts to protect the tuyeres by "shrouding" have been disclosed for nickel matte refining processes, e.g. in U.S. Pat. No. 4,045,215. However, this results in added expense due to the increasing complexity of the process, which requires tuyeres having concentric tubes so that protective coolant, such as fuel oil, natural gas or nitrogen may be blown in around the oxygen.

Another known process is the so-called "Mitsubishi" process, (see Nagano et al., "Commercial Operation of Mitsubishi Continuous Copper Smelting and Converting Process", *International Symposium on Copper Extraction & Refining*, 1976, pp. 439–57). In this method, the bath is top blown with oxygen by a complex mechanism, which utilizes a set of consumable lances fixed to a rotating member, as described in U.S. Pat. No. 3,968,956. As the lances rotate, they are lowered into the hot zone to achieve maximum efficiency. However, the extreme heat quickly consumes the lances, which thus require replacement on a regular basis. Furthermore, the rotating member is plagued by a number of drawbacks owing to its complexity. For example, the near impossibility of obtaining a proper seal between the rotating member and furnace shell leads to hazardous dusting. Also, a build-up of material must be constantly removed.

These obstacles had been overcome by the use of a "top blowing/bottom stirring" mechanism, as described with respect to the converting of white metal copper by Marcuson et al. in U.S. Pat. No. 4,830,667. In the Marcuson process, an oxygen containing gas is blown into the surface of the molten bath while the bath is stirred from below with a non-reactive sparging gas, such as nitrogen. The stirring of the bath continuously supplies fresh reactants to the surface, where oxidation can readily take place. It has now been found that this efficient mechanism can be successfully applied as part of a novel process for the conversion of FeS-containing non-ferrour matte.

Furthermore, in contrast to previous understanding, it has now been demonstrated that a top blowing/bottom stirring conversion process can be quite successful in accepting non-ferrous matte as its sole feed. It had been believed that the production of iron-containing slag as a result of cold matte addition would interfere with the conversion reactions taking place in the melt. However, it has been surprisingly found that the reaction proceeds efficiently so long as the slag thickness is maintained below a certain threshold.

SUMMARY OF THE INVENTION

Accordingly, a novel conversion process is claimed in which molten non-ferrous furnace matte, essentially nickel and/or copper sulfide and iron sulfide, is provided in a suitable vessel, such as a modified Pierce-Smith converter. The bath is stirred from below with a non-reactive sparging gas, such as nitrogen, and surface-blown from above with an oxygen-containing gas. A flux is added to the melt to raise a fluid slag. In addition, cold crushed non-ferrous feed, such as additional matte, is added continuously or semi-continuously to the bath. The cold feed acts to maintain the temperature of the bath, within the range 1200° to 1325° C. so as to prevent overheating which can damage the converter lining. The matte addition also serves as a source for additional converter feed. As the reaction progresses, the slag layer is periodically skimmed or allowed to continuously overflow and additions of flux and cold feed are made when necessary. When it is no longer possible to raise a quality slag, a non-ferrous sulfide matte is obtained having a greatly reduced iron content. The resulting low-iron matte is then ready for further processing.

In the case of nickel matte, silica is normally used as the flux. Converting proceeds as long as a quality slag can be raised, i.e. until the iron content falls below about 10%. Silica is also a suitable flux for combined nickel/copper matte.

Even better results are obtained when processing copper matte. While a silica flux used for copper converting may result in a mushy slag after the iron has been reduced, a lime flux is ideal. The lime forms an easily managed fluid slag which remains fluid and continues to arise even under highly oxidized conditions. The results is that the copper matte may be blown until essentially all of the iron has been removed, and the sulfur content is below about 1%.

While the claimed process is ideally suited to the conversion of a high-iron feed such as matte, other cold feeds such as non-ferrous concentrates or scrap metal may be added either periodically or as a mixture with matte.

A further advantage of the present invention is the maximum utilization of the available energy. As the iron and sulfur are oxidized, large amounts of heat are evolved. The addition of cold matte feed helps to maintain the bath temperature at an acceptable level. Additionally, however, the heat of oxidation is applied to melting the newly introduced matte. Thus, a process is achieved for the conversion of non-ferrous matte which takes place autogenously yet exhibits good temperature control.

DETAILED DESCRIPTION OF THE INVENTION

Tests involving the conversion of non-ferrous matte by top blowing/bottom stirring were conducted in a modified Pierce-Smith converter. Tonnage oxygen was blown onto a molten bath of nickel matte using a water-cooled oxygen lance located at one end of the reactor shell and inclined at about 45 degrees. Bottom stirring was accomplished by sparging nitrogen through five porous plugs spaced along the bottom of the shell, one of which was located directly below the impingement point between the oxygen jet and the bath. This particular plug was located so that the nitrogen sparging gas would part the slag at this point and rapidly expose the matte to the oxygen atmosphere. In addition, sufficient stirring helps to prevent the formation of magnetite in the slag as a result of over-oxidation of the slag. Such a build-up of magnetite would deprive the melt of oxygen needed for oxidation.

TEST 1

The first test began with 113 tonnes of flash furnace nickel matte analyzing 32.9% Fe. 24.0% Ni and 22.8% S. The bath was heated to 1232° C. using a supplemental burner. 7.3 tonnes of 60% $SiO_2$ flux were added through the reactor mouth and the oxygen was blown through the lance at a rate of 3.6 tonnes per hour. After about 40 minutes of blowing, 9 tonnes of cold, crushed Ni matte having 14.1% Fe were added as a coolant to keep the bath temperature below 1260° C. Blowing continued for another 40 minutes after which another 9 tonnes of crushed Ni matte were added. At the end of about 2 hours of blowing, one 20 tonne ladle of slag (18.4% $SiO_2$) was skimmed off and the remaining matte was analyzed at 22.6% Fe. Another 7.3 tonnes of flux were added and again the shell was blown for 2 hours, adding 20 tonnes crushed Ni matte. A second 20 tonnes of slag (19.9% $SiO_2$) was skimmed off and the iron level in the matte was measured at 15.96%. A final 2 hour blow with 7.3 tonnes flux and 18 tonnes Ni matte addition resulted in a third 20 tonnes of slag containing 21.6% $SiO_2$ and the remaining matte at 11.9% Fe.

An analysis of the total slag removed showed iron at 52%, or 29.8 tonnes. As 21.8 tonnes of actual $O_2$ were used, this gives a $O_2$ efficiency of 117% (where theoretical $O_2$ of 25.5 tonnes would be required to react with the actual iron removed.)

TEST 2

The second test commenced with 109 tonnes of semi-converted nickel matte analyzing 13.7% Fe. The same procedure as outlined in the previous test was followed initially. However, since less iron was present, less heat was generated from the converting reaction, therefore requiring less coolant (crushed Ni matte). The first slag (27.5% $SiO_2$) was skimmed off, but, as the iron content in the matte dropped below 7%, it became impossible to raise a second slag. Finally, a ladle of furnace matte (22.8 tonnes at 35.0% Fe) was added, the shell blown for 30 minutes and the second slag (26.3% $SiO_2$) was removed. Further blowing again resulted in a poor quality slag when the iron dropped below 7%.

Thus, it is clear from the above tests that, when processing nickel matte, a certain minimum level of iron must be present in the matte to maintain continued operation using the claimed process. The inability to raise a quality iron-containing slag below about 10% Fe in matte demonstrates the lower level of operatability for the process.

The converting of copper matte, using a lime flux, does not exhibit a lower level of operability described above. Because of the unique ability of lime to form a quality slag in the presence of copper even under highly oxidized conditions, the reaction may proceed until essentially all of the iron has been removed.

With regard to slag removal, it is believed that while the reactions proceed surprisingly well under a slag-covered surface, should the slag layer become too thick, say greater than about 6–8 inches (15–20 cm), it may interfere with oxygen contact at the surface. Therefore, slag should be skimmed at regular intervals or be allowed to continuously overflow to ensure efficient operation.

What is claimed is:

1. A process for converting an iron-containing nickel and/or copper sulfide matte comprising the steps of:

(a) providing molten matte in a suitable vessel, (b) top blowing an oxygen-containing gas onto the surface of the melt while stirring the melt from below with a non-reactive sparging gas so as to cause oxidation of the iron and sulfur, (c) adding a flux so as to raise an immiscible iron-containing slag on the surface of the melt, (d) adding cold, iron-containing nickel and/or copper feed to the melt to maintain the temperature thereof, (e) removing slag from the melt surface, and (f) repeating any of steps (b)–(e) as often as necessary to reduce the iron concentration of the matte to a desired level.

2. The process of claim 1, wherein top blowing is accomplished through a lance projecting into the vessel, and bottom stirring is accomplished through a series of porous plugs spaced along the bottom of the vessel.

3. The process of claim 1, wherein the oxygen containing gas is oxygen or oxygen-enriched air.

4. The process of claim 1, wherein the non-reactive sparging gas is nitrogen.

5. The process of claim 3, wherein at least one of the porous plugs is located directly below the point at which the oxygen-containing gas impinges the bath so that the slag is parted at the impinging point by the sparging gas to expose the matte to the oxygen-containing atmosphere.

6. The process of claim 1, wherein the feed of step (d) is chosen from the group consisting of nickel and/or copper matte, nickel and/or copper concentrate, and a combination of any of the above.

7. The process of claim 6, wherein the feed of step (d) is nickel and/or copper matte.

8. The process of claim 1, wherein the feed is added on a semicontinuous basis.

9. The process of claim 1, wherein the removal of slag is accomplished by periodic skimming of the slag or by allowing for continuous overflow of the slag.

10. The process of claim 9, wherein the thickness of the slag is maintained at less than about 20 cm.

* * * * *